US006603438B2

(12) United States Patent
Strickland

(10) Patent No.: US 6,603,438 B2
(45) Date of Patent: Aug. 5, 2003

(54) HIGH POWER BROADBAND FEED

(75) Inventor: Peter C. Strickland, Ottawa (CA)

(73) Assignee: EMS Technologies Canada Ltd., Ottawa (CA)

( * ) Notice: Subject to any disclaimer, the term of this patent is extended or adjusted under 35 U.S.C. 154(b) by 0 days.

(21) Appl. No.: 10/079,911

(22) Filed: Feb. 22, 2002

(65) Prior Publication Data

US 2002/0113746 A1 Aug. 22, 2002

Related U.S. Application Data

(60) Provisional application No. 60/270,192, filed on Feb. 22, 2001.

(51) Int. Cl.[7] ..... H01Q 13/02

(52) U.S. Cl. ..... 343/786; 343/772

(58) Field of Search ..... 343/785, 786, 343/772, 705, 708, 821; 333/21 A, 26, 137

(56) References Cited

U.S. PATENT DOCUMENTS

| | | | | |
|---|---|---|---|---|
| 3,568,204 A | * | 3/1971 | Blaisdell | 343/725 |
| 4,554,552 A | * | 11/1985 | Alford et al. | 343/786 |
| 4,630,062 A | * | 12/1986 | Dewey | 343/786 |
| 5,793,334 A | * | 8/1998 | Anderson et al. | 343/786 |
| 5,959,591 A | * | 9/1999 | Aurand | 343/786 |
| 5,973,654 A | | 10/1999 | Lusignan et al. | |
| 6,097,348 A | | 8/2000 | Chen et al. | |
| 6,118,412 A | | 9/2000 | Chen | |
| 6,154,183 A | | 11/2000 | Wolf | |
| 6,271,799 B1 | | 8/2001 | Rief et al. | |
| 6,281,855 B1 | * | 8/2001 | Aoki | 343/786 |

FOREIGN PATENT DOCUMENTS

WO WO 01/91226 A1 11/2001

OTHER PUBLICATIONS

Cutoff and Bandwidth Characteristics of a Circular Coaxial Waveguide with Four Symmetrically Placed Double Ridges Hendry Z. Zhang et al — IEEE Antennas and Propagation-Society International Symposium, Vol. 2, pp. 1454–1457.

* cited by examiner

*Primary Examiner*—Tan Ho
(74) *Attorney, Agent, or Firm*—Shapiro Cohen

(57) ABSTRACT

A ridged feed horn antenna for use in broadband satellite communications. This multi-ridged feed horn operates in a receive band of 10–13 GHz and a transmit band of 14–15 GHz. The ridged feed horn antenna comprises excitation conductors which excite the field between each of the ridges in the feed horn antenna. The excitation conductors are connected to each of the ridges. A waveguide, terminated at the back of the horn antenna, enables the ridges to guide the energy from their respective excitation conductors toward the mouth of the feed horn antenna. A planar balun and matching circuit, located at the back of the horn antenna, may be used to feed each of the excitation conductors. Furthermore, the cross-section of each excitation conductor is chosen so as to optimize horn antenna performance. Each excitation conductor extends outwardly from the back of the horn and is parallel to the longitudinal axes of the horn waveguide. Essentially, a dual-ridged feed horn would require two excitation conductors and a quad-ridged feed horn would require four excitation conductors.

5 Claims, 2 Drawing Sheets

HIGH POWER BROADBAND FEED

This application relates to U.S. Provisional Patent Application No. 60/270,192 filed Feb. 22, 2001.

FIELD OF INVENTION

This invention relates to ridged horns utilized in satellite communications. More particularly, this invention relates to a multi-ridged horn antenna utilizing separate excitation conductors for each ridge, whereby the cross-section of the conductor is chosen to optimize horn performance, and provide high power handling capability.

BACKGROUND TO THE INVENTION

In the field of satellite communications, antenna systems are required to have a broad bandwidth while having a narrow antenna beam width. The broad bandwidth enables the antenna system to both transmit and receive signals over frequency bands of several GHz. The narrow antenna beam width provides a high gain for signals that are received and transmitted over a particular frequency to and from a particular satellite, and provides discrimination between satellites.

Due to the high speed at which aircraft travel, antenna systems which are mounted on aircraft are required to maintain a low profile. The low profile minimizes drag. Typically, an antenna system is placed within a radome that has a height restriction in the range of 4 inches to 6 inches depending on the type of aircraft. As such, the antenna itself must be very compact and also equally broadband. The focus-fed parabolic reflector antenna may be utilized in such conditions. While the parabolic reflector must be compact so must the feed to avoid excessive aperture blockage of the antenna system. A quad-ridged horn may be utilized in such antenna systems.

The ridged horn antenna is a type of broadband antenna that is often used in communications systems. A ridged horn antenna generally includes ridges which carry electromagnetic energy from the signal source to the aperture area of the ridged horn antenna. An excitation conductor, usually a conductive wire, excites a field between the ridges which ultimately radiates from the horn antenna.

More specifically, a quad-ridged horn is an example of a ridged horn antenna which has a hollow conductive conduit, known as the horn waveguide, usually having a circular square or cross section for propagation of signal waves. The horn waveguide may be formed of an electrically conductive material or of a non-conductive material that is plated or coated with an electrically conductive material. Moreover, to receive signals, horn antennas are dimensioned and flared to receive a concentration of low energy at one or more specific frequencies within the throat area of the horn. A quad-ridge horn is dual-polarized and includes four ridges or tapered ridges which aid in the propagation of the signal waves.

These conventional quad-ridged horns have very limited power dissipation capability due to the small diameter of the wire that excites the fields between the ridges. A problem arises in that a high power signal must be transmitted in many systems, including aircraft applications, which requires high power handling within the quad-ridged horn.

In the prior art, the U.S. Pat. No. 6,154,183, issued to Wolf, teaches a waveguide antenna with a coaxial feed which can be used with both round waveguides and square waveguides. Wolf utilizes these coaxial feeds to improve the electrical power capabilities of the waveguide antenna. Wolf teaches the use of coaxial probes/conductors connected to the coaxial feed which vary in length to adjust the waveguide impedance. However, Wolf does not discuss the use of ridged horn antennas nor does he teach excitation probes which are independently coupled to each ridge.

The U.S. Pat. No. 6,271,799, issued to Rief et al., discloses a dual-polarized quad-ridged antenna horn for small size requirements. Rief teaches a phased array antenna from a plurality of antenna horns connected to a dielectric substrate, whereby the horn axis is orthogonal to the substrate. The antenna horns themselves comprise four spaced apart electrically conductive ridges extending longitudinally on an inner side of an electrically conductive conduit (waveguide). Rief further teaches the use of two feed elements for each quad-ridged antenna horn. Each feed element is positioned on the dielectric substrate orthogonal to the axis. As such, each feed is connected to two opposing ridges. The Rief patent, however, does not teach the use of separate excitation conductors for each ridge. Furthermore, Rief does not teach excitation conductors which extend outwardly from the back of the horn to form a cavity between a matching circuit (or a planar balun) and the back of the horn.

In view of the aforementioned shortcomings, the present invention seeks to provide a quad-ridged horn antenna having excitation conductors driven by a matching circuit which provides high power handling capability while the horn antenna is in operation.

SUMMARY OF THE INVENTION

The present invention relates to a ridged feed horn antenna for use in broadband satellite communications. This multi-ridged feed horn operates in a receive band of 10–13 GHz and a transmit band of 14–15 GHz. With the expected antenna data rates being several MBPS. The antenna feed structure must be compact and capable of operating at a very high power. The ridged feed horn antenna comprises excitation conductors which excite the field between each of the ridges in the feed horn antenna. The excitation conductors are connected to each of the ridges and run parallel to the horn axis. A waveguide, terminated at the back of the horn antenna enables the ridges to guide the energy from their respective excitation conductors toward the mouth of the feed horn antenna. A planar balun and matching circuit, located at the back of the horn antenna, may be used to feed each of the excitation conductors. Furthermore, the cross-section of each excitation conductor is chosen so as to optimize horn antenna performance (impedance match bandwidth and power handling). Each excitation conductor extends outwardly from the back of the horn and is parallel to the longitudinal axes of the horn waveguide. Essentially, a dual-ridged feed horn would require two excitation conductors and a quad-ridged feed horn would require four excitation conductors. The excitation conductors form a multiconductor balanced transmission line.

Moreover, the horn antenna includes a cavity to ensure a broad bandwidth match between the excitation conductors and the ridges. The cavity is located between the ridges and a termination wall of the waveguide. This multi-ridged horn antenna, through use of multiple excitation conductors, is capable of handling high levels of power. Problems such as overheating of conductive wires, which have adverse affects on the antenna capabilities, are eliminated by the present invention.

In one aspect, the present invention provides ridged horn antenna, including:

a horn waveguide being an electrically conductive conduit, and the horn waveguide having a first end and a second opposite end along a horn axis, the first end forming a termination wall, and the horn waveguide forming a mouth at the second end, at least two ridges being spaced apart and extending longitudinally on an inner side of the horn waveguide relative to horn axis and each of the at least two ridges tapering to the mouth of the horn waveguide, the at least two ridges having a 180 degree rotational symmetry, each of the at least two ridges being connected to a corresponding excitation conductor, each excitation conductor extending parallel to the horn axis from the back termination wall to one of the at least two ridges.

BRIEF DESCRIPTION OF THE DRAWINGS

The present invention will now be described with reference to the drawings, in which.

DETAILED DESCRIPTION

Figure 1:
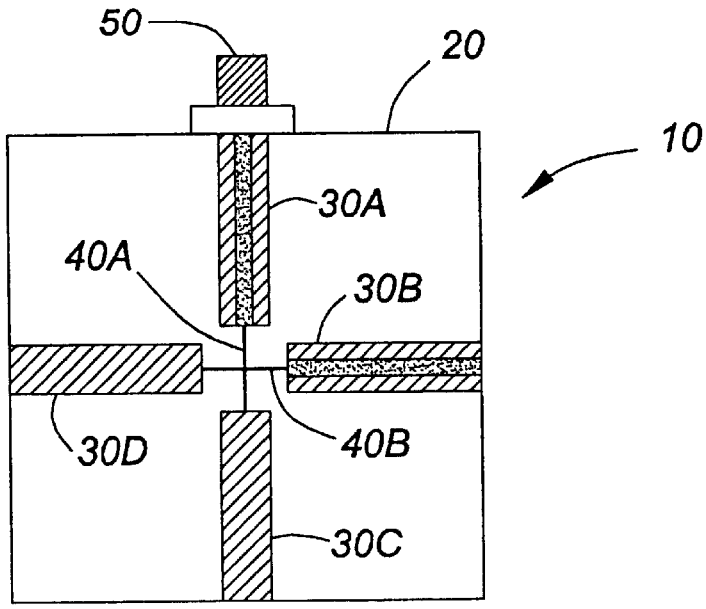
PRIOR ART FIG. 1
FIG. 1 is a frontal view of a ridged horn antenna and its excitation conductors according to the prior art.

FIG. 1 illustrates a frontal view of a quad-ridged horn antenna 10 according to the prior art. The term front or frontal refers to the end of the horn facing away from a parabolic reflector. The outside surface of the horn antenna 10 is an electrically conductive conduit, hereinafter a horn waveguide 20. The horn antenna 10 further comprises four ridges 30A, 30B, 30C, 30D and two excitation conductors 40A, 40B. Each excitation conductor is connected to two of the four ridges 30A, 30B, 30C, 30D. The excitation conductors 40A, 40B excite the field between the four ridges which radiates from the antenna horn 10. An input/output connector 50 is in turn connected to both excitation conductors 40A, 40B to provide an input means and an output means to the excitation conductors 40A, 40B. Typically, a dual-ridged horn antenna will have one excitation conductor while a quad ridged horn antenna will have two excitation conductors.

Unfortunately, the excitation conductors, of the prior art, have small dimensions and as such are not capable of dissipating high power. Consequently, the horn antenna is generally a low power device. In particular, the wires, connecting the excitation conductors and crossing the between the ridges, have a very small diameter. These wires may overheat, burn up, or become disconnected under high power conditions.

Figure 2:
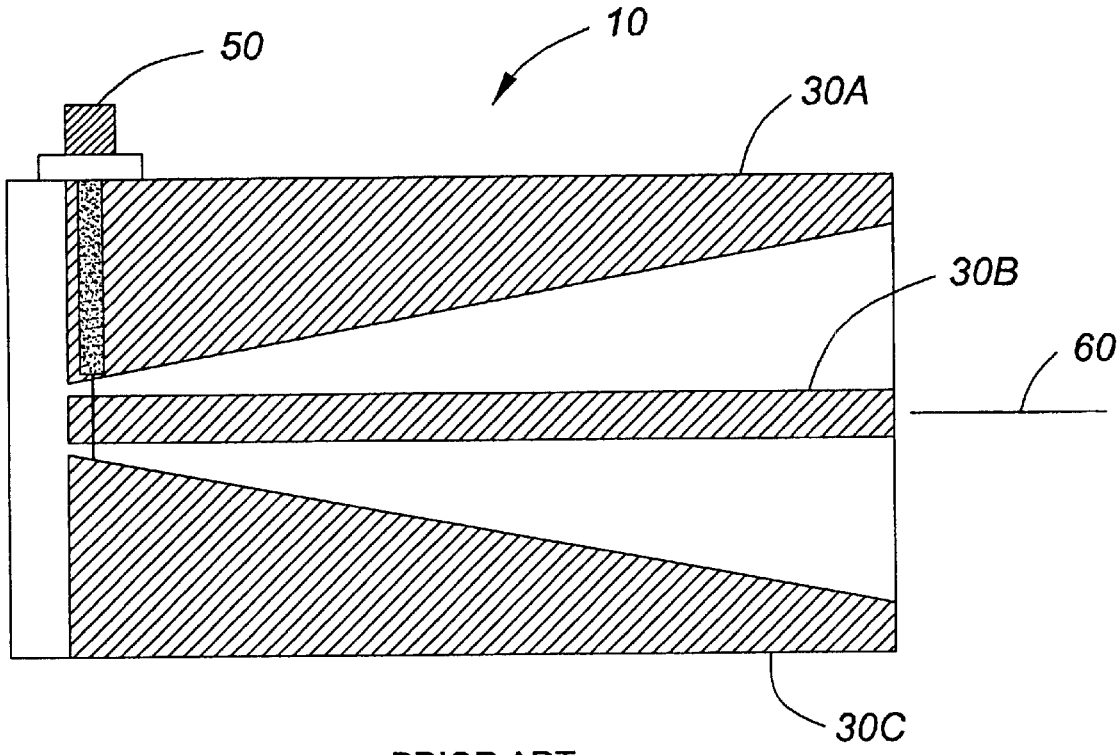
PRIOR ART FIG. 2
FIG. 2 is a sectional side view of the ridged horn antenna of FIG. 1 according the prior art.

FIG. 2 further illustrates a sectional side view of the quad-ridged horn antenna 10 of the prior art. Both ridges 30A and 30C are shown, as well as ridge 30B, in this cross-sectional view of the quad-ridged horn antenna 10. As shown in FIG. 2, all four ridges 30A, 30B, 30C, 30D are spaced apart and extend longitudinally on an inner side of the horn waveguide relative to horn axis 60. Each of the four ridges 30 taper to the mouth of the horn waveguide. FIG. 2 illustrates the tapering of the ridges 30A and 30C. It should be mentioned that the four ridges 30A, 30B, 30C, 30D are positioned such that the horn antenna 10 has 90 degree rotational symmetry.

Figure 3:
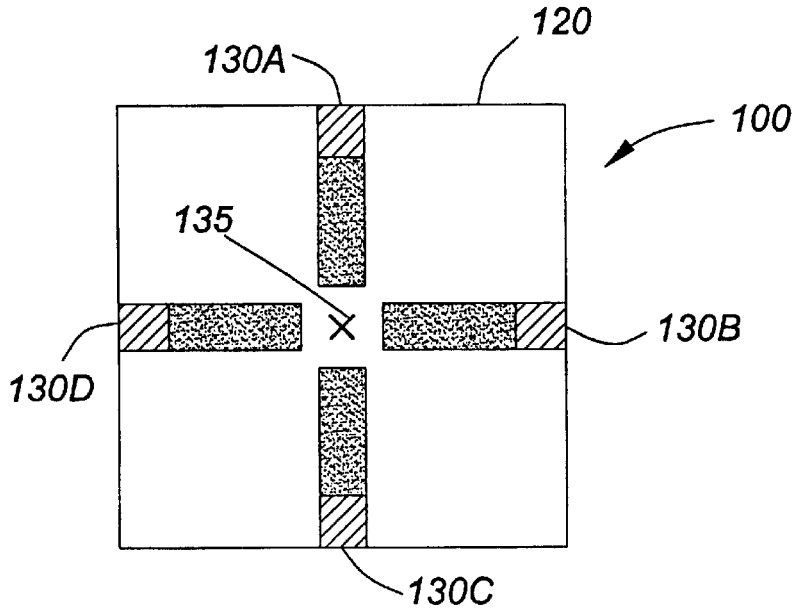
FIG. 3 is a rear view of the horn antenna according to the present invention.

FIG. 3 illustrates a rear view of the horn antenna 100 according to the present invention. The horn antenna is comprised of a horn waveguide 120 and four ridges 130A, 130B, 130C, 130D which are spaced apart and extend longitudinally along the horn waveguide 120. The horn waveguide 120 minimizes the radiation outside the main beam of the radiating ridges and provides a mechanical means for supporting the four ridges 130A, 130B, 130C, 130D. In FIG. 3, the dark shading of each of the four ridges 130A, 130B, 130C, 130D represents the tapering of the ridges to the mouth of the horn antenna. As FIG. 3 is a rear view of the horn antenna 100—a cross-section of the horn antenna 100 at the mouth of the horn antenna 100—then the light shading of the four ridges 130A, 130B, 130C, 130D represents the portion of the four ridges 130A, 130B, 130C, 130D which extends longitudinally from the mouth of the horn antenna 100 relative to the horn axis 135.

Figure 4:
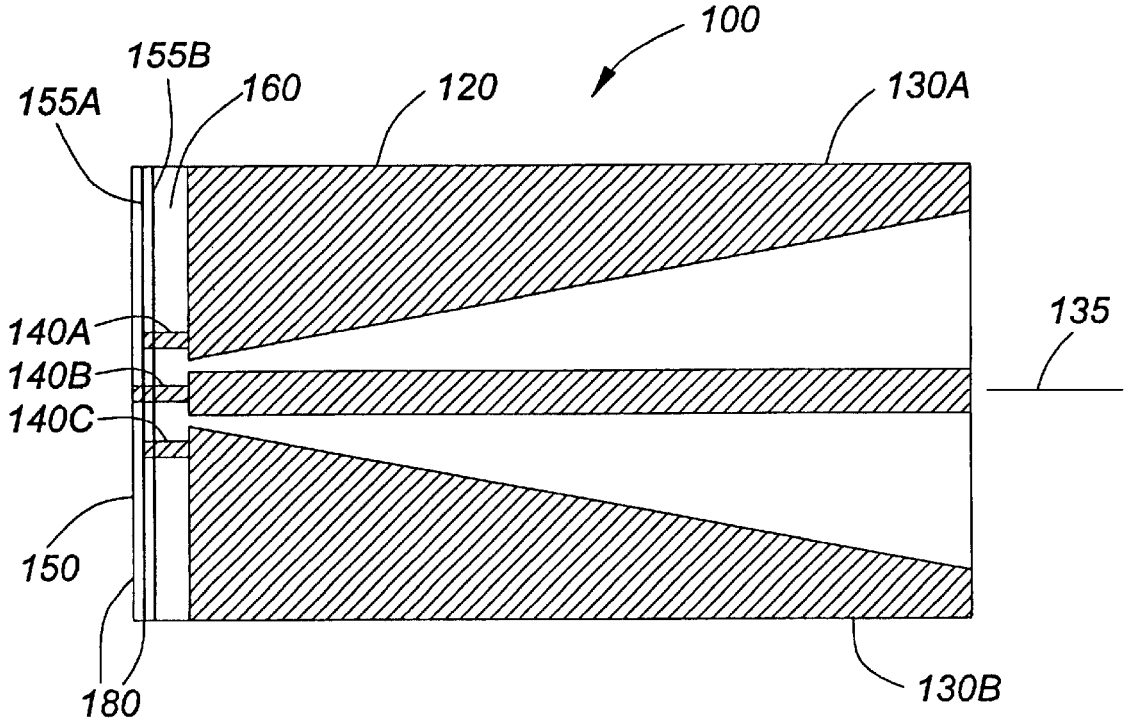
FIG. 4 is a sectional side view of the horn antenna having excitation conductors disposed according to the present invention.

FIG. 4 illustrates the use of excitation conductors 140A, 140B, 140C, and 140D (not shown as it is hidden by 140B) in accordance with the present invention. The waveguide 120 is terminated by a conductive termination wall 150. The present invention provides an input feed to the four ridges 130A, 130B, 130C, 130D by means of four excitation conductors 140A, 140B, 140C, 140D, respectively. The number of excitation conductors 140A, 140B, 140C, 140D utilized in accordance with the present invention is double the number utilized in the prior art. The number of excitation conductors increases the power handling capabilities of the horn antenna 100. The four excitation conductors 140A, 140B, 140C, 140D extend from the termination wall 150 parallel to the horn axis 135. The waveguide 120, in conjunction with the four ridges 130A, 130B, 130C, 130D, guides the electromagnetic energy from the four excitation conductors 140A, 140B, 140C, 140D toward the mouth of the horn antenna 100.

Also, the use of two connectors, 155A and 155B, provides an input means and an output means to the four excitation conductors 140A, 140B, 140C, 140D. The excitation conductors 140A, 140B, 140C, 140D excite an electric field between the four ridges 130A, 130B, 130C, 130D. The field created radiates from the horn antenna 100. It should be mentioned that the excitation conductors may have any cross-section and their respective lengths need not be uniform. The excitation conductors are designed such that horn antenna performance and power dissipation capabilities are optimized to some extent. Where the four excitation conductors 140A, 140B, 140C, 140D meet with the termination wall 150, the excitation conductors will pass through holes (not shown). These holes will provide a suitable amount of clearance around the perimeter of the excitation conductors, such that they are not in direct contact with the termination wall 150.

Alternatively, waveguides or transmission lines may be used instead of the two connectors 155A and 155B. A cavity 170 is formed between the four ridges and the termination wall 150. The excitation conductors 140A, 140B, 140C, 140D may be further connected to coaxial cables on the outside of the termination wall 150 or may mate with a planar circuit or another transmission device.

According to an alternative embodiment of the present invention, the excitation conductors 140A, 140B, 140C, 140D are connected to a planar circuit 180, on the outside or the inside of the termination wall 150. The planar circuit 180 may either be a planar balun or an impedance matching circuit. The use of a planar circuit 180 is a compact means for providing feed to each of the four excitation conductors 140A, 140B, 140C, 140D and an impedance matching or a correct phasing of the antenna signal. Typically, the opposing excitation conductors, 140A and 140C, or, 140B and 140D, will receive an input with equal amplitudes and 180 degrees relative phase. Each opposing pair of excitation conductors may either be excited independently or excited with appropriate amplitudes and phases to achieve the desired polarisation and radiation pattern at the horn antenna.

What is claimed is:

1. A ridged horn antenna, including:

a horn waveguide being an electrically conductive conduit, and the horn waveguide having a first end and a second opposite end along a horn axis, the first end forming a termination wall, and the horn waveguide forming a mouth at the second end, at least two ridges being spaced apart and extending longitudinally on an inner side of the horn waveguide relative to horn axis and each of the at least two ridges tapering to the mouth of the horn waveguide, the at least two ridges having 180 degree rotational symmetry, each of the at least two ridges being connected to a corresponding excitation conductor, each excitation conductor extending parallel to the horn axis from the back termination wall to one of the at least two ridges.

2. A ridged horn antenna as defined in claim 1, wherein each excitation conductor is connected to a planar circuit at the first end of the horn waveguide.

3. A ridged horn antenna as defined in claim 2, wherein the planar circuit comprises both a balun and an impedance matching means.

4. A ridged horn antenna as defined in claim 1, wherein each excitation conductor extends through a hole in the termination wall.

5. A ridged horn antenna as defined in claim 1, wherein the excitation conductors form a balanced transmission line, impedance of the transmission line designed for optimal impedance matching.

* * * * *